US008887795B2

(12) United States Patent
Toda et al.

(10) Patent No.: US 8,887,795 B2
(45) Date of Patent: Nov. 18, 2014

(54) HEAT EXCHANGER AND WATER HEATER INCLUDING THE SAME

(75) Inventors: Masayuki Toda, Nagoya (JP); Akira Kumagai, Nagoya (JP); Hiromitsu Sasada, Nagoya (JP)

(73) Assignee: Rinnai Corporation, Nagoya-Shi (JP)

( * ) Notice: Subject to any disclaimer, the term of this patent is extended or adjusted under 35 U.S.C. 154(b) by 1279 days.

(21) Appl. No.: 12/648,512

(22) Filed: Dec. 29, 2009

(65) Prior Publication Data

US 2010/0096103 A1 Apr. 22, 2010

(30) Foreign Application Priority Data

Aug. 11, 2008 (JP) ..... 2008-206895

(51) Int. Cl.

| | |
|---|---|
| ***F28F 13/18*** | (2006.01) |
| ***F28F 19/02*** | (2006.01) |
| ***F28F 19/00*** | (2006.01) |
| ***F28F 9/00*** | (2006.01) |
| ***F28F 21/08*** | (2006.01) |
| ***F28F 1/32*** | (2006.01) |
| ***F28F 13/12*** | (2006.01) |

(52) U.S. Cl.

CPC ..... *F28F 21/088* (2013.01); *F28F 9/001* (2013.01); *F28F 21/089* (2013.01); *F28F 1/32* (2013.01); *F28F 21/085* (2013.01); *F28F 13/12* (2013.01)

USPC ..... 165/133; 165/134.1

(58) Field of Classification Search

CPC ..... C23C 18/1653; C23C 18/31

USPC ..... 165/109.1, 133, 134.1; 205/191; 427/239, 304, 405, 437

See application file for complete search history.

(56) References Cited

U.S. PATENT DOCUMENTS

| | | | | |
|---|---|---|---|---|
| 4,671,212 | A * | 6/1987 | Smith | 122/18.2 |
| 6,793,008 | B2 * | 9/2004 | von Schweinichen | 165/89 |
| 2001/0004009 | A1 * | 6/2001 | MacKelvie | 165/47 |
| 2001/0047861 | A1 * | 12/2001 | Maeda et al. | 165/167 |

(Continued)

FOREIGN PATENT DOCUMENTS

| | | |
|---|---|---|
| JP | 08-178585 | 7/1996 |
| JP | 08-327277 | 12/1996 |
| JP | 2004-150760 | 5/2004 |

OTHER PUBLICATIONS

M. Venkatraman and J.P. Neuman, "The Cr-SN (Chromium—Tin) System", Bulletin of Alloy Phase Diagrams vol. 9 No. 2 1988.*

(Continued)

*Primary Examiner* — Allana Lewin
*Assistant Examiner* — Dawit Muluneh
(74) *Attorney, Agent, or Firm* — Rankin, Hill & Clark LLP

(57) ABSTRACT

There is provided a heat exchanger and a water heater having the heat exchanger including a uniform thickness of tin plating layer on the inner surface of a water feeding pipe. The heat exchanger H includes copper pipes 8 and 10 disposed in a casing 1 as a water feeding pipe 4 and a turbulent flow generator 13 disposed in the copper pipes 8 and 10. The turbulent flow generator 13 has a copper plating layer 14 on the surface portion thereof. The tin plating layers 17 and 18 are disposed on the inner surface of the copper pipes 8 and 10 and the surface of the turbulent flow generator 13.

14 Claims, 5 Drawing Sheets

(56) References Cited

U.S. PATENT DOCUMENTS

| | | | | |
|---|---|---|---|---|
| 2002/0035847 | A1* | 3/2002 | Yundt, Jr. | 62/354 |
| 2003/0182979 | A1* | 10/2003 | Hinago et al. | 72/206 |
| 2004/0154787 | A1* | 8/2004 | Hughes et al. | 165/164 |
| 2005/0194475 | A1* | 9/2005 | Kim et al. | 239/690 |
| 2007/0160868 | A1* | 7/2007 | Watanabe et al. | 428/675 |
| 2008/0122442 | A1* | 5/2008 | Fukuda et al. | 324/321 |

OTHER PUBLICATIONS

H. Okamoto, Ni—Sn (Nickel—Tin), Journal of Phase Equilibria and Diffusion, vol. 29, No. 3, 2008.*

* cited by examiner

HEAT EXCHANGER AND WATER HEATER INCLUDING THE SAME

BACKGROUND OF THE INVENTION

1. Field of the Invention

The present invention relates to a heat exchanger and a water heater including the heat exchanger.

2. Description of the Related Art

The heat exchanger for use in a gas instantaneous water heater and other water heaters includes a water feeding pipe disposed in a casing; and a large number of heat absorbing fins disposed around the water feeding pipe in a region crossing an upper portion inside the casing of the water feeding pipe, of the piping route of the water feeding pipe. The heat exchanger performs heat exchange mainly using the heat absorbing fins.

Conventionally, a copper pipe has been used as the water feeding pipe. The copper pipe has advantages such as high thermal conductivity and excellent bending workability. On the contrary, the copper pipe has a known disadvantage that copper ions are dissolved under a specific water quality, causing pitting corrosion or so-called "blue water". As a measure against the pitting corrosion and "blue water", it is effective to perform a plating process on an inner surface of the copper pipe.

Japanese Patent Laid-Open No. 8-178585 discloses a technique of forming a tin plating layer on the inner surface of the copper pipe by causing an electroless tin plating solution to circulate inside the copper pipe after the heat exchanger is assembled. According to Japanese Patent Laid-Open No. 8-178585, the tin plating layer is described to block the copper ions from being dissolved and prevent the pitting corrosion or "blue water" from occurring.

However, conventionally the heat exchanger has a disadvantage that when the electroless tin plating solution is circulated through the copper pipe, the thickness of the tin plating layer becomes nonuniform, and thus cannot prevent the pitting corrosion or "blue water" from occurring.

SUMMARY OF THE INVENTION

In order to solve the above problem, the present invention has been made, and an object of the present invention is to provide a heat exchanger having a uniform thickness of tin plating layer formed on an inner surface of a copper pipe serving as a water feeding pipe.

Another object of the present invention is to provide a water heater including the heat exchanger.

The present inventors have made zealous studies to find why when the electroless tin plating solution is circulated through the copper pipe, the thickness of the tin plating layer becomes nonuniform. As a result of zealous studies, the inventors have found that a turbulent flow generator disposed inside the copper pipe is the culprit for why the thickness of the tin plating layer becomes nonuniform.

In order to suppress film boiling from occurring in hot water flowing through the copper pipe serving as the water feeding pipe and to prevent abnormal noise from occurring, the heat exchanger has a turbulent flow generator disposed inside the copper pipe. Examples of the abnormal noise include a plosive sound of bubbles. The turbulent flow generator is shaped like a coil spring or the like and functions to generate a turbulent flow by agitating hot water flowing through the copper pipe. The turbulent flow generator is generally made of stainless-steel material.

Here, as illustrated in FIG. 8, if there is sufficient spacing between a turbulent flow generator 30 and an inner surface of a copper pipe 31, a uniform thickness of tin plating layer 32 is formed on the inner surface of the copper pipe 31 by circulating the electroless tin plating solution through the copper pipe 31. Note that if the turbulent flow generator 30 is made of stainless-steel material, a passivated oxide film is formed on the surface thereof. For this reason, the tin plating layer 32 is not formed on the surface of the turbulent flow generator 30.

In contrast to this, as illustrated in FIG. 9, if there is no sufficient spacing between the turbulent flow generator 30 and the inner surface of the copper pipe 31 such that the turbulent flow generator 30 is in close contact with or very close to the inner surface of the copper pipe 31, the thickness of a tin plating layer 32 becomes nonuniform. This is because the electroless tin plating solution is less likely to enter a gap between the turbulent flow generator 30 and the inner surface of the copper pipe 31. More specifically, the tin plating layer 32 is not formed on the surface of the turbulent flow generator 30 made of stainless-steel material and thus under such a condition, it is considered that the in plating layer 32 is formed only on the inner surface of the copper pipe 31, causing the thickness of the tin plating layer 32 to be nonuniform.

In light of this, in order to achieve the above object, the present invention provides a heat exchanger including a casing; a copper pipe disposed in the casing as a water feeding pipe; and a turbulent flow generator disposed in the copper pipe, wherein at least the surface portion of the turbulent flow generator is made of copper-based metal and a plating layer made of tin-based metal is laminated on the inner surface of the copper pipe and the surface of the turbulent flow generator.

According to the heat exchanger of the present invention, at least the surface portion of the turbulent flow generator is made of copper-based metal. Therefore, when the electroless tin plating solution is circulated in the copper pipe, a plating layer made of tin-based metal is formed on the surface of the turbulent flow generator in the same manner as on the inner surface of the copper pipe.

Therefore, according to the heat exchanger of the present invention, a plating layer made of tin-based metal is laminated both on the inner surface of the copper pipe and on the surface of the turbulent flow generator. As a result, even if the turbulent flow generator is in close contact with or very close to the inner surface of the copper pipe, the heat exchanger of the present invention can provide a uniform thickness of the plating layer made of tin-based metal.

According to the heat exchanger of the present invention, the copper pipe may be made of pure copper or copper alloy. For example, the copper pipe may be either a copper pipe made of oxygen free copper containing 99.96 wt % or more copper or a copper pipe made of phosphorus deoxidized copper containing 99.90 wt % or more copper and 0.015 to 0.04 wt % phosphorus.

Moreover, according to the heat exchanger of the present invention, the turbulent flow generator may be anything as long as at least the surface portion of the turbulent flow generator is made of pure copper or a copper-based metal such as a copper alloy and a plating layer made of tin-based metal is formed on the surface thereof in the same manner as on the inner surface of the copper pipe. Examples of the turbulent flow generator include those made of stainless-steel material and having a copper plating layer made of copper-based metal formed on the surface thereof.

Moreover, according to the heat exchanger of the present invention, preferably, if the turbulent flow generator is in close contact with or very close to the inner surface of the copper pipe, the plating layer made of tin-based metal not only covers the surface of the turbulent flow generator but also continues to the plating layer laminated on the inner surface of the copper pipe. The plating layer covering the surface of the turbulent flow generator continues to the plating layer laminated on the inner surface of the copper pipe. Thus, even if an empty space (nest) is formed between the turbulent flow generator and the copper pipe, the empty space can be sealed in the plating layer. Accordingly, even if the empty space is formed, the empty space does not serve to expose the surface of the turbulent flow generator or the inner surface of the copper pipe.

Moreover, the water heater of the present invention includes the above configured heat exchanger.

DETAILED DESCRIPTION OF THE PREFERRED EMBODIMENTS

Hereinafter, embodiments of the present invention will be described in further detail by referring to the accompanying drawings.

Figure 1:
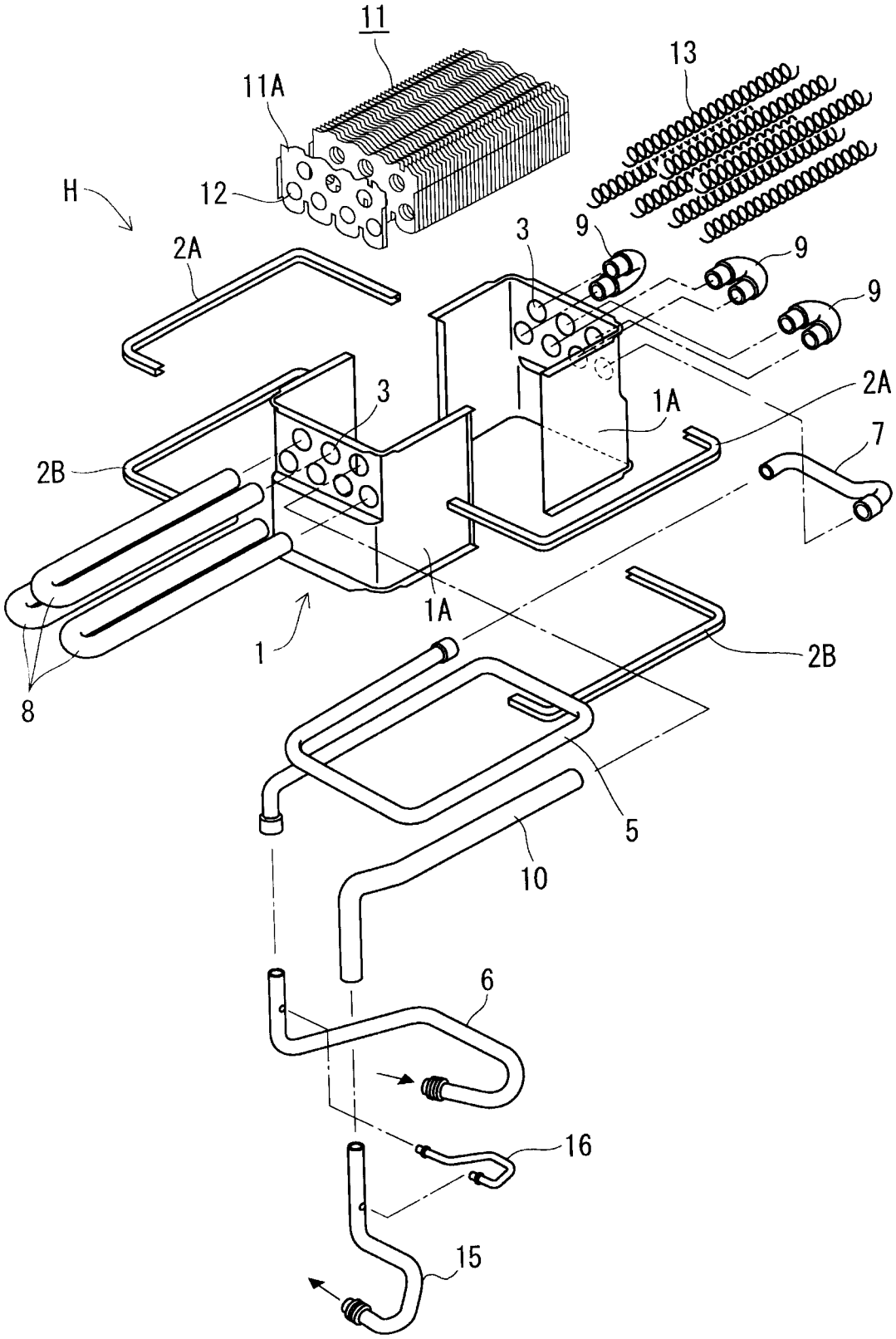
FIG. 1 is an exploded perspective view illustrating a configuration of the heat exchanger in accordance with the present invention.
Figure 2:
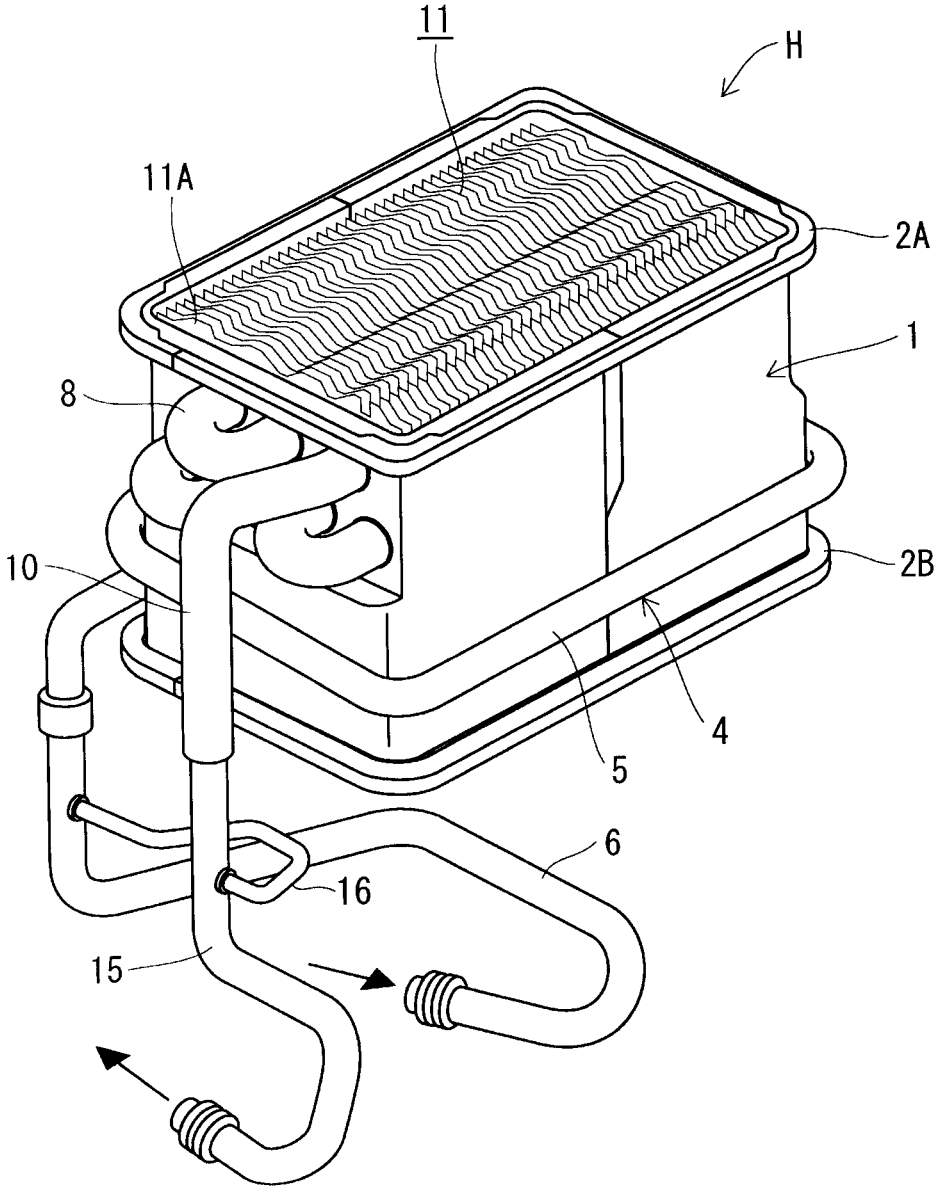
FIG. 2 is a perspective view illustrating the configuration of the heat exchanger after assembly in accordance with the present invention.

The heat exchanger H of the present embodiment is incorporated into a water heater. As illustrated in FIGS. 1 and 2, the heat exchanger H has a casing 1 and the casing 1 has a pair of subcasings 1A. Both subcasings 1A are each formed by folding a metal plate made of pure copper or copper alloy into an approximately C-shape.

When the casing 1 is assembled, the edges of the subcasings 1A are opposed to and butted against each other and the butted edges are caulked together. A pair of flange blocks 2A and 2B are each disposed on the upper and Lower edges of the casing 1 for the purpose of reinforcement. The flange blocks 2A and 2B are each attached to the casing 1 by spot welding. The casing 1 has a plurality of insertion holes 3 opened in an approximately upper half region of both wall surfaces facing with each other.

The casing 1 has a water feeding pipe 4 forming a water feeding route of the heat exchanger by connecting a plurality of pipes each being a metal pipe made of pure copper or copper alloy. A coiled water pipe 5 constituting part of the water feeding pipe 4 is disposed around the center portion of the casing 1 in the height direction thereof. The coiled water pipe 5 is wrapped around the outer peripheral surface of the lower half of the casing 1 and fixed to the casing 1 by brazing.

The upstream end of the coiled water pipe 5 is connected to a water supply connecting pipe 6 located in one end side of the casing 1 in the width direction thereof. The water supply connecting pipe 6 is connected to a water supply source (not illustrated).

Meanwhile, the downstream end of the coiled water pipe 5 is connected to one end of an inlet pipe 7 for heat exchange. The other end of the inlet pipe 7 is connected to one of a plurality (three in the figure) of hair pin pipes 8. The hair pin pipes 8 are each folded into a U-shape and are inserted into inside the casing 1 through each pair of the insertion holes 3 formed on a wall surface opposite to a wall surface connected to the inlet pipe 7 in the casing 1.

On the side connected to the inlet pipe 7, the end portions of the hair pin pipes 8 protruding through the insertion holes 3 formed on the wall surface thereof are connected to a plurality (three in the figure) of U-shaped bend pipes 9. As a result, the hair pin pipes 8 are connected to each other through the respective bend pipes 9 to form a continuous water passage. The bend pipe 9 located on the most downstream side is connected to one end of a heat absorbing pipe 10 inserted into inside the casing 1 through the insertion hole 3 on the wall surface on the opposite side.

Before the hair pin pipes 8 and the heat absorbing pipe 10 are disposed inside the casing 1, a fin block 11 in which a large number of fins 11A are disposed is contained in an approximately upper half portion inside the casing 1. The fins 11A have through-holes 12 for allowing the hair pin pipes 8 and the heat absorbing pipe 10 to pass therethrough. Each through-hole 12 is disposed in a position corresponding to the respective insertion holes 3 of the casing 1. Note that the hole edge of each through-hole 12 is in close contact with the corresponding outer peripheral surface of the hair pin pipes 8 and the heat absorbing pipe 10 without a space along the entire periphery thereof.

Before connection of the inlet pipe 7 and the bend pipes 9, turbulent flow generators (also called silencers) 13 are inserted into inside the hair pin pipes 8 and the heat absorbing pipe 10. The turbulent flow generators 13 are each formed into a coil shape having about a length reaching an approximately entire length of each of the hair pin pipes 8 and the heat absorbing pipe 10. The turbulent flow generators 13 serve to agitate hot water passing through inside the hair pin pipes 8 and the heat absorbing pipe 10 to generate turbulent flows and as a result, to reduce generation of abnormal sound caused by film boiling and the like.

The end portion of the heat absorbing pipe 10 extends outward the casing 1 on the end portion opposite to the side connected to the bend pipes 9 and is connected to a hot water supply connecting pipe 15. The hot water supply connecting pipe 15 is connected to a hot water supply opening such as a faucet (not illustrated).

Moreover, a bypass pipe 16 is disposed between the hot water supply connecting pipe 15 and the water supply connecting pipe 6. A bypass mixing valve (not illustrated) is disposed in a bypass route including the bypass pipe 16 so as to be able to adjust hot water discharge temperature by taking a predetermined amount of hot water from part of the hot water supplied to the water supply connecting pipe 6 and mixing the hot water into the hot water supply connecting pipe 15.

According to the heat exchanger H of the present embodiment, the hair pin pipes 8 and the heat absorbing pipe 10 forming the water passage is each made of a copper pipe and the copper pipe may be made of pure copper or copper alloy. For example, the copper pipe may be either a copper pipe (JIS C1020T) made of oxygen free copper containing 99.96 wt % or more copper or a copper pipe (JIS C1220T) made of phosphorus deoxidized copper containing 99.90 wt % or more copper and 0.015 to 0.04 wt % phosphorus.

Examples of the copper pipe include a red brass pipe specified in JIS C2200T; a brass pipe specified in JIS C2600T, JIS C2700T, and JIS C2800T; a brass pipe for condensers specified in JIS C4430T; and a cupronickel pipe for condensers specified in JIS C7060T.

According to the heat exchanger H, the turbulent flow generator 13 is made of stainless-steel wire and the surface thereof has a copper plating layer 14 formed thereon by electrolytic plating. The turbulent flow generator 13 may be made by performing a plating process on a coil shaped wire or by performing a plating process on a linear wire and then coiling the wire. Moreover, the turbulent flow generator 13 may be made by cutting the wire to a predetermined size and then performing the plating process thereon or by performing the plating process on a long continuous wire and then cutting the wire to a predetermined size.

Moreover, the turbulent flow generator 13 may be mane of a copper wire specified in JIS C1020W or JIS C1220W. In this case, the plating process is not required.

Moreover, the turbulent flow generator 13 may be mane by performing the plating process on a piano wire or a brass wire. In this case, if the copper plating layer 14 is damaged for some reason, corrosion may occur.

Figure 3:
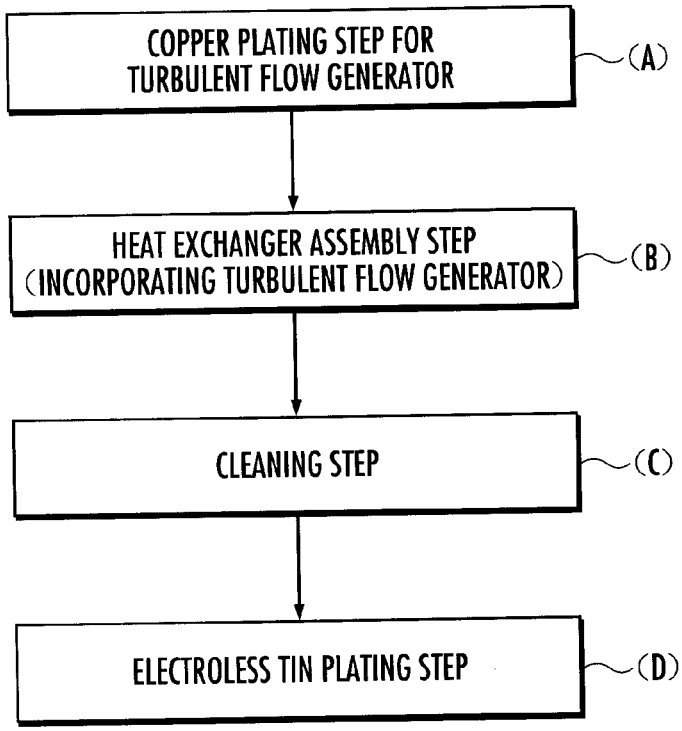
FIG. 3 is a flowchart illustrating a process of manufacturing the heat exchanger in accordance with the present invention.

The heat exchanger H of the present embodiment can be made in the steps illustrated in FIG. 3.

First, in step (A), the electrolytic plating process is performed on a coil-shaped stainless-steel wire to form the turbulent flow generator 13 whose surface has the copper plating layer 14 thereon as described above. Note that if the turbulent flow generator 13 is made of a copper wire, the above step (A) may be omitted.

Next, in step (B), the heat exchanger H illustrated in FIGS. 1 and 2 is assembled. At this time, the turbulent flow generators 13 are disposed inside the hair pin pipes 8 and the heat absorbing pipe 10 as described above.

Then, in step (C), cleaning is performed inside the water feeding pipe 4 forming a water feeding route of the heat exchanger H and on the surface of the turbulent flow generator 13. The cleaning is performed such that the water supply connecting pipe 6 and the hot water supply connecting pipe 15 of the heat exchanger H are connected to a cleaning solution tank and the cleaning solution stored in the cleaning solution tank is supplied from the water supply connecting pipe 6 to the water feeding pipe 4. The water feeding pipe 4 has a passage starting at the water supply connecting pipe 6, passing through the inlet pipe 7, the hair pin pipes 8, the bend pipes 9, and the heat absorbing pipe 10, and reaching the hot water supply connecting pipe 15.

As the cleaning solution, for example, an alkaline degreasing solution, an acid cleaning solution, and a chemical polishing solution are used in this order. Each cleaning solution works as follows. First, the alkaline degreasing solution works to clean oil contaminations such as process oils and sebums attached inside the water feeding pipe 4 and the surface of the turbulent flow generator 13. Next, the acid cleaning solution works to clean inorganic contaminations such as oxides, adhesions and dirt attached inside the water feeding pipe 4 and the surface of the turbulent flow generator 13. Finally, the chemical polishing solution works to remove any contaminations remaining after the cleaning using the acid cleaning solution by slightly etching the inside of the water feeding pipe 4 and the surface of the turbulent flow generator 13. Note that in the step (C), after the cleaning using each of the cleaning solutions is completed, pure water cleaning is performed each time.

When the cleaning in step (C) is completed, the process moves to step (D) where electroless tin plating is performed inside the water feeding pipe 4 forming the water feeding route of the heat exchanger H and on the surface of the turbulent flow generator 13. The electroless tin plating is performed such that the water supply connecting pipe 6 and the hot water supply connecting pipe 15 of the heat exchanger H are connected to an electroless tin plating solution tank, and the electroless tin plating solution stored in the electroless tin plating solution tank is supplied from the water supply connecting pipe 6 to the water feeding pipe 4.

Examples of the electroless tin plating solution include a commercially available electroless tin plating solution such as SUBSTAR SN-2 (product name) of OKUNO CHEMICAL INDUSTRIES CO., LTD. Alternatively, a publicly known electroless tin plating solution such as the one disclosed in Japanese Patent No. 3712245 may be used. Note that in step (D), when the plating process using the electroless tin plating solution is completed, pure water cleaning is performed.

Figure 4:
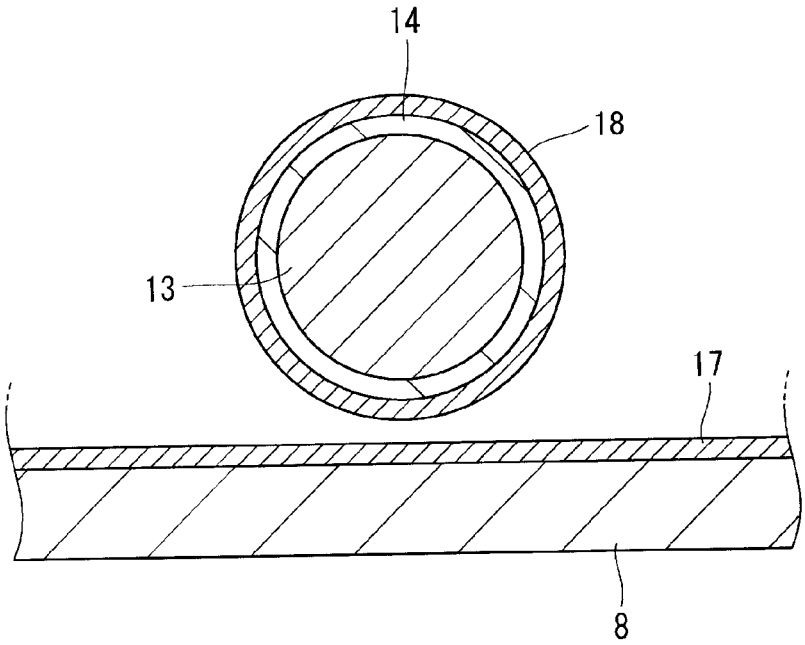
FIG. 4 is an enlarged sectional view illustrating a tin-based plating layer formed in a portion where a turbulent flow generator is spaced apart from an inner surface of a copper pipe.
Figure 5:
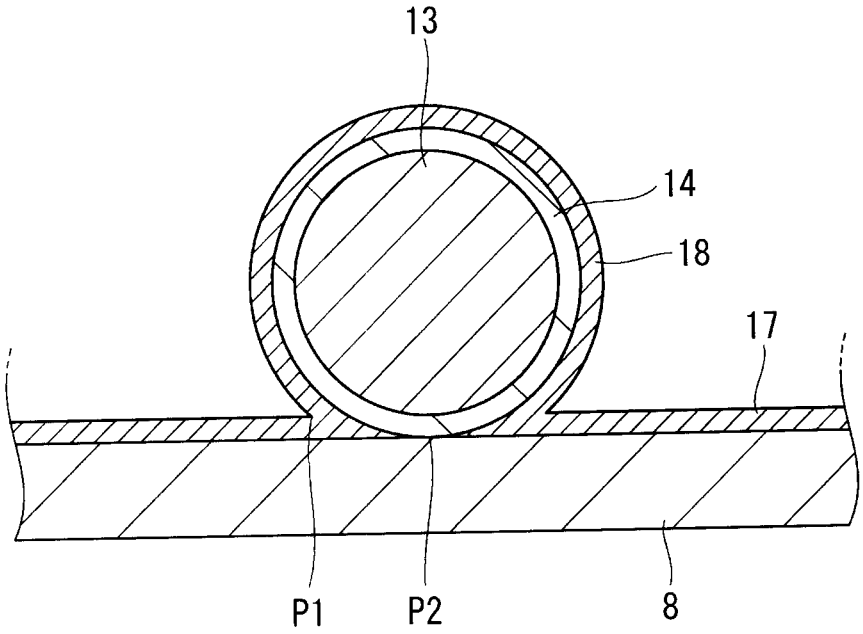
FIG. 5 is an enlarged sectional view illustrating the tin-based plating layer formed in a portion where the turbulent flow generator is in close contact with the inner surface of the copper pipe.
Figure 6:
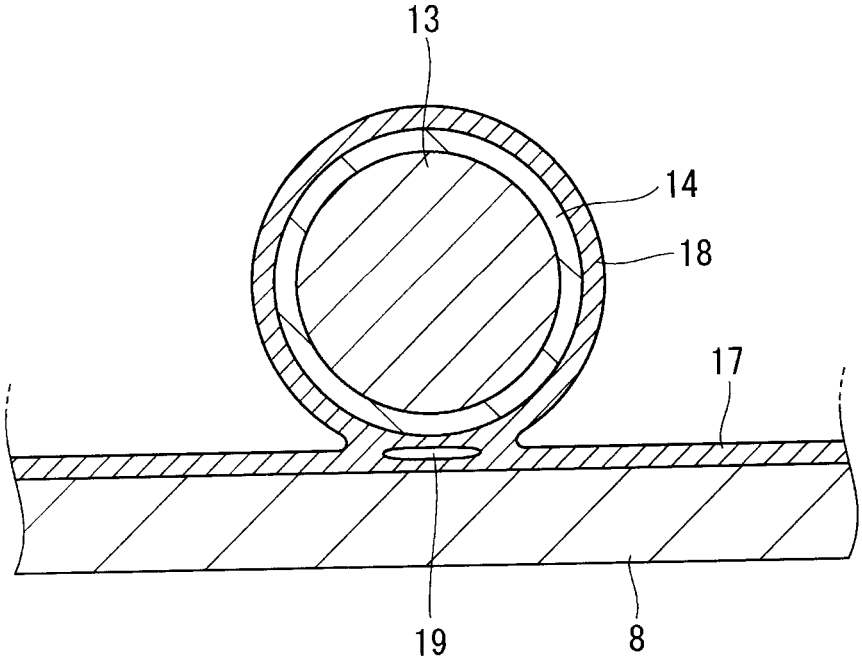
FIG. 6 is an enlarged sectional view illustrating a state where an empty space occurs between the surface of the turbulent flow generator and the inner surface of the copper pipe.

According to the plating process using the electroless tin plating solution, as illustrated in FIGS. 4 to 6, the tin plating layers 17 and 18 having a uniform thickness of 1 to 2 μm are formed inside the water feeding pipe 4 and on the surface of the turbulent flow generator 13.

Here, as illustrated in FIG. 4, if the turbulent flow generator 13 is sufficiently spaced apart from the inner surface of the hair pin pipe 8 or the heat absorbing pipe 10 (the hair pin pipe 8 is illustrated in the figure), a uniform thickness of tin plating layer 17 is formed on the inner surface of the hair pin pipe 8 or the neat absorbing pipe 10 and a uniform thickness of tin plating layer 18 is formed on the surface of the turbulent flow generator 13 each independently.

On the contrary, if the turbulent flow generator 13 is close to the inner surface of the hair pin pipe 8 or the neat absorbing pipe 10, the electroless tin plating solution is less likely to enter between the gap of the turbulent flow generator 13 and the hair pin pipe 8 or the neat absorbing pipe 10. As a result, unfortunately, the thickness of the tin plating layer 17 formed on the inner surface of the hair pin pipe 8 or the heat absorbing pipe 10 is likely to be nonuniform.

In contrast to the above, according to the heat exchanger H of the present embodiment, the copper plating layer 14 formed on the surface of the turbulent flow generator 13 is made of copper or copper alloy having approximately the same composition of the hair pin pipe 8 or the heat absorbing pipe 10. Thus, the tin plating layer 17 is formed on the inner surface of the hair pin pipe 8 or the heat absorbing pipe 10 as well as the tin plating layer 18 is formed on the surface of the turbulent flow generator 13 (actually the surface of the copper plating layer 14), each having a uniform thickness.

Here, as illustrated in FIG. 5, if the turbulent flow generator 13 is in contact with the inner surface of the hair pin pipe 8 or the heat absorbing pipe 10 (the hair pin pipe 8 is illustrated in the figure), the tin plating layer 17 on the inner surface of the hair pin pipe 8 or the heat absorbing pipe 10 and the tin plating layer 18 on the surface of the turbulent flow generator 13 are continuously formed and thus an empty space (nest) is not formed in the tin plating layers 17 and 18. At this time, a connection point P1 between the tin plating layers 17 and 18 is formed at a position radially spaced apart from a contact point P2 between the turbulent flow generator 13 and the hair pin pipe 8 or the heat absorbing pipe 10.

In contrast, as illustrated in FIG. 6, if the turbulent flow generator 13 is slightly spaced apart from the inner surface of the hair pin pipe 8 or the heat absorbing pipe 10 (the hair pin pipe 8 is illustrated in the figure), an empty space (nest) 19 may be formed in a region where the tin plating layers 17 and 18 are close to each other. However, in this case, as described above, the connection point P1 between the tin plating layers 17 and 18 is formed at a position radially spaced apart from the region where the turbulent flow generator 13 and the hair pin pipe 8 or the heat absorbing pipe 10 come closer together. Therefore, the empty space 19 can be sealed within the mutually continuous tin plating layers 17 and 18. Accordingly, even if an empty space 19 occurs, the surface of the turbulent flow generator 13 and the inner surface of the hair pin pipe 8 or the heat absorbing pipe 10 can be prevented from being exposed.

As described above, according to the heat exchanger H of the present embodiment, regardless of the distance between surface of the turbulent flow generator 13 and the inner surface of the hair pin pipe 8 or the heat absorbing pipe 10, a uniform thickness of tin plating layer 17 can be formed on the inner surface of the hair pin pipe 8 or the heat absorbing pipe 10. As a result, the heat exchanger H of the present embodiment can be used even in an area poor in water quality without a pitting corrosion or "blue water".

Figure 7:
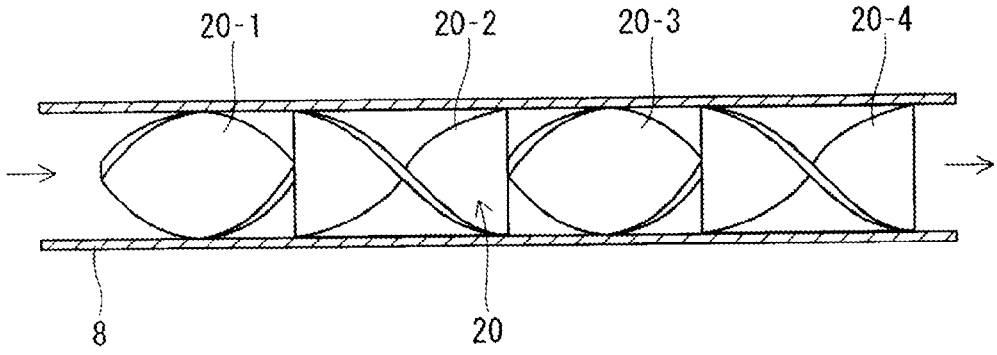
FIG. 7 is a sectional view illustrating another embodiment of the turbulent flow generator used in the present invention.
Figure 8:
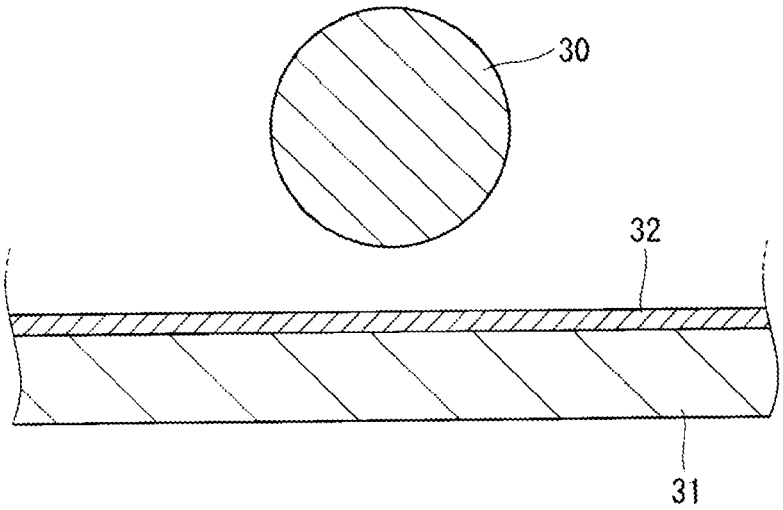
FIG.8 (RELATED ART)
FIG. 8 is a sectional view illustrating a state where electroless tin plating is performed based on a conventional technique in a state where the turbulent flow generator is spaced apart from the inner surface of the copper pipe.
Figure 9:
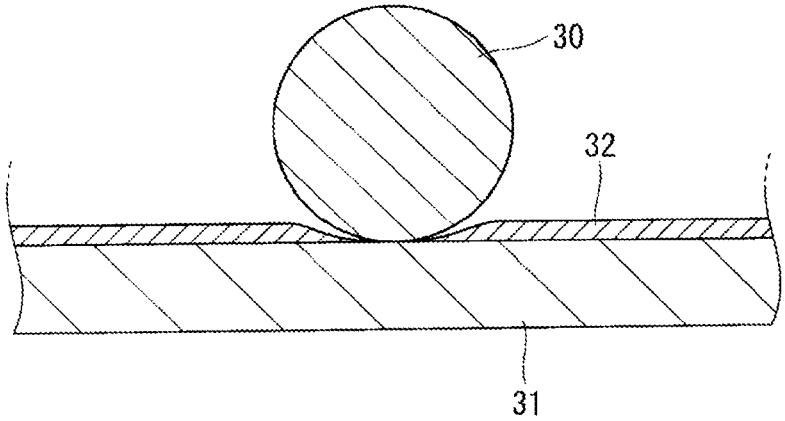
FIG.9 (RELATED ART)
FIG. 9 is a sectional view illustrating a state where electroless tin plating is performed based on the conventional technique in a state where the turbulent flow generator is in close contact with the inner surface of the copper pipe.

According to the heat exchanger H of the present embodiment, a coil shaped turbulent flow generator 13 is used, but a plate shaped turbulent flow generator 20 as illustrated in FIG. 7 may be used. The turbulent flow generator 20 illustrated in FIG. 7 is configured such that a large number of elements 20-1 to 20-4 are connected in a length direction of the hair pin pipe 8 or the neat absorbing pipe 10 (the hair pin pipe 8 is illustrated in the figure). Each of the elements 20-1 to 20-4 is made of a plate material to form a helicoid with 180° torsion applied around the axis line. The external diameter of the helicoid is slightly smaller than the internal diameter of the hair pin pipe 8 or the heat absorbing pipe 10. Moreover, the adjacent elements 20-1 to 20-4 are formed 90° out of phase with each other. Note that the elements 20-1 to 20-4 may be separated independently.

The heat exchanger H can use the above configured turbulent flow generators 20 to prevent an abnormal sound from occurring by automatically applying turning torque around the axis line while hot water passes through inside the hair pin pipe 8 or the heat absorbing pipe 10. Moreover, in the hair pin pipe 8 or the heat absorbing pipe 10 where the turbulent flow generators 20 are disposed, a uniform thickness of tin plating layer can be formed on the surface of the turbulent flow generators 20 and on the inner surface of the hair pin pipe 8 or the heat absorbing pipe 10 by passing the electroless tin plating solution through the water feeding pipe 4.

What is claimed is:

1. A heat exchanger comprising a casing; a copper pipe disposed in the casing as a water feeding pipe; and a turbulent flow generator disposed in the copper pipe, wherein at least a surface portion of the turbulent flow generator is made of copper-based metal and a plating layer made of tin-based metal is laminated on an inner surface of the copper pipe and the surface portion of the turbulent flow generator, wherein the turbulent flow generator is made of stainless-steel material and has a copper plating layer made of copper-based metal being formed directly on the surface portion thereof, wherein the copper plating layer is formed by electrolytic plating, and wherein the plating layer made of tin-based metal is formed by causing an electroless plating solution to circulate inside the copper pipe.

2. The heat exchanger according to claim 1, wherein the copper pipe may be either a copper pipe made of oxygen free copper containing 99.96 wt % or more copper or a copper pipe made of phosphorus deoxidized copper containing 99.90 wt % or more copper and 0.015 to 0.04 wt % phosphorus.

3. The heat exchanger according to claim 1, wherein the plating layer made of the tin-based metal not only covers the surface of the turbulent flow generator but also continues to the plating layer laminated on the inner surface of the copper pipe.

4. The heat exchanger according to claim 3, wherein an empty space is defined in the plating layer made of tin-based metal laminated on the inner surface of the copper pipe and the surface portion of the turbulent flow generator, the empty space defined at a position between the turbulent flow generator and the copper pipe.

5. The heat exchanger according to claim 3, wherein the surface portion of the turbulent flow generator is spaced from the inner surface of the copper pipe by a space, the plating layer made of tin-based metal laminated on the inner surface of the copper pipe and the surface portion of the turbulent flow generator fills the space as a space filling portion, and an empty space is defined in the space filling portion at a position between the turbulent flow generator and the copper pipe.

6. The heat exchanger according to claim 3, wherein the turbulent flow generator is in contact with the inner surface of the copper pipe at a contact point, and the contact point is covered by the plating layer made of the tin-based metal.

7. The heat exchanger according to claim 1, wherein an entirety of the surface portion of the turbulent flow generator is made of copper-based metal, and the plating layer made of tin-based metal is laminated on the inner surface of the copper pipe and all portions of the surface portion of the turbulent flow generator that are spaced from the inner surface of the copper pipe.

8. A water heater having a heat exchanger comprising a casing; a copper pipe disposed in the casing as a water feeding pipe; and a turbulent flow generator inserted in the copper pipe, wherein at least a surface portion of the turbulent flow generator is made of copper-based metal and a plating layer made of tin-based metal is laminated on an inner surface of the copper pipe and the surface portion of the turbulent flow generator, wherein the turbulent flow generator is made of stainless-steel material and has a copper plating layer made of copper-based metal being formed directly on the surface portion thereof, wherein the copper plating layer is formed by electrolytic plating, and wherein the plating layer made of tin-based metal is formed by causing an electroless plating solution to circulate inside the copper pipe.

9. The water heater according to claim 8, wherein the copper pipe may be either a copper pipe made of oxygen free copper containing 99.96 wt % or more copper or a copper pipe made of phosphorus deoxidized copper containing 99.90 wt % or more copper and 0.015 to 0.04 wt % phosphorus.

10. The water heater according to claim 8, wherein the plating layer made of the tin-based metal not only covers the surface of the turbulent flow generator but also continues to the plating layer laminated on the inner surface of the copper pipe.

11. The water heater according to claim 10, wherein an empty space is defined in the plating layer made of tin-based metal laminated on the inner surface of the copper pipe and the surface portion of the turbulent flow generator, the empty space defined at a position between the turbulent flow generator and the copper pipe.

12. The water heater according to claim 10, wherein the surface portion of the turbulent flow generator is spaced from the inner surface of the copper pipe by a space, the plating layer made of tin-based metal laminated on the inner surface of the copper pipe and the surface portion of the turbulent flow generator fills the space as a space filling portion, and an empty space is defined in the space filling portion at a position between the turbulent flow generator and the copper pipe.

13. The water heater according to claim 10, wherein the turbulent flow generator is in contact with the inner surface of the copper pipe at a contact point, and the contact point is covered by the plating layer made of the tin-based metal.

14. The water heat according to claim 8, wherein an entirety of the surface portion of the turbulent flow generator is made of copper-based metal, and the plating layer made of tin-based metal is laminated on the inner surface of the copper pipe and all portions of the surface portion of the turbulent flow generator that are spaced from the inner surface of the copper pipe.

* * * * *